United States Patent [19]

Eakman et al.

[11] 4,157,246

[45] Jun. 5, 1979

[54] HYDROTHERMAL ALKALI METAL CATALYST RECOVERY PROCESS

[75] Inventors: James M. Eakman, Houston; LeRoy R. Clavenna, Baytown, both of Tex.

[73] Assignee: Exxon Research & Engineering Co., Florham Park, N.J.

[21] Appl. No.: 872,859

[22] Filed: Jan. 27, 1978

[51] Int. Cl.[2] ..... C10J 3/06; C10D 5/02

[52] U.S. Cl. ..... 48/197 R; 48/210; 208/10; 252/412; 562/513

[58] Field of Search ..... 48/197 R, 202, 206, 48/210; 423/209, 208, 206 R, 186; 252/420, 421, 425, 412; 208/10; 260/542, 527 R; 562/513, 609

[56] References Cited

U.S. PATENT DOCUMENTS

| | | | |
|---|---|---|---|
| 820,374 | 5/1906 | Weise et al. | 260/542 |
| 1,574,875 | 3/1926 | Enderli | 260/542 |
| 2,043,534 | 6/1936 | Karlsruhe et al. | 260/542 |
| 4,057,512 | 11/1977 | Vadovic et al. | 48/197 R |

FOREIGN PATENT DOCUMENTS

| | | | |
|---|---|---|---|
| 9008 of | 1906 | United Kingdom | 260/542 |
| 415871 | 9/1934 | United Kingdom | 260/542 |

*Primary Examiner*—S. Leon Bashore

*Assistant Examiner*—George C. Yeung

*Attorney, Agent, or Firm*—Yale S. Finkle

[57] ABSTRACT

In a coal gasification operation or similar conversion process carried out in the presence of an alkali metal-containing catalyst wherein solid particles containing alkali metal residues are produced, alkali metal constituents are recovered from the particles primarily in the form of water soluble alkali metal formates by treating the particles with a calcium or magnesium-containing compound in the presence of water at a temperature between about 250° F. and about 700° F. and in the presence of added carbon monoxide. During the treating process the water insoluble alkali metal compounds comprising the insoluble alkali metal residues are converted into water soluble alkali metal formates. The resultant aqueous solution containing water soluble alkali metal formates is then separated from the treated particles and any insoluble materials formed during the treatment process, and recycled to the gasification process where the alkali metal formates serve as at least a portion of the alkali metal constituents which comprise the alkali metal-containing catalyst. This process permits increased recovery of alkali metal constituents, thereby decreasing the overall cost of the gasification process by reducing the amount of makeup alkali metal compounds necessary.

15 Claims, 1 Drawing Figure

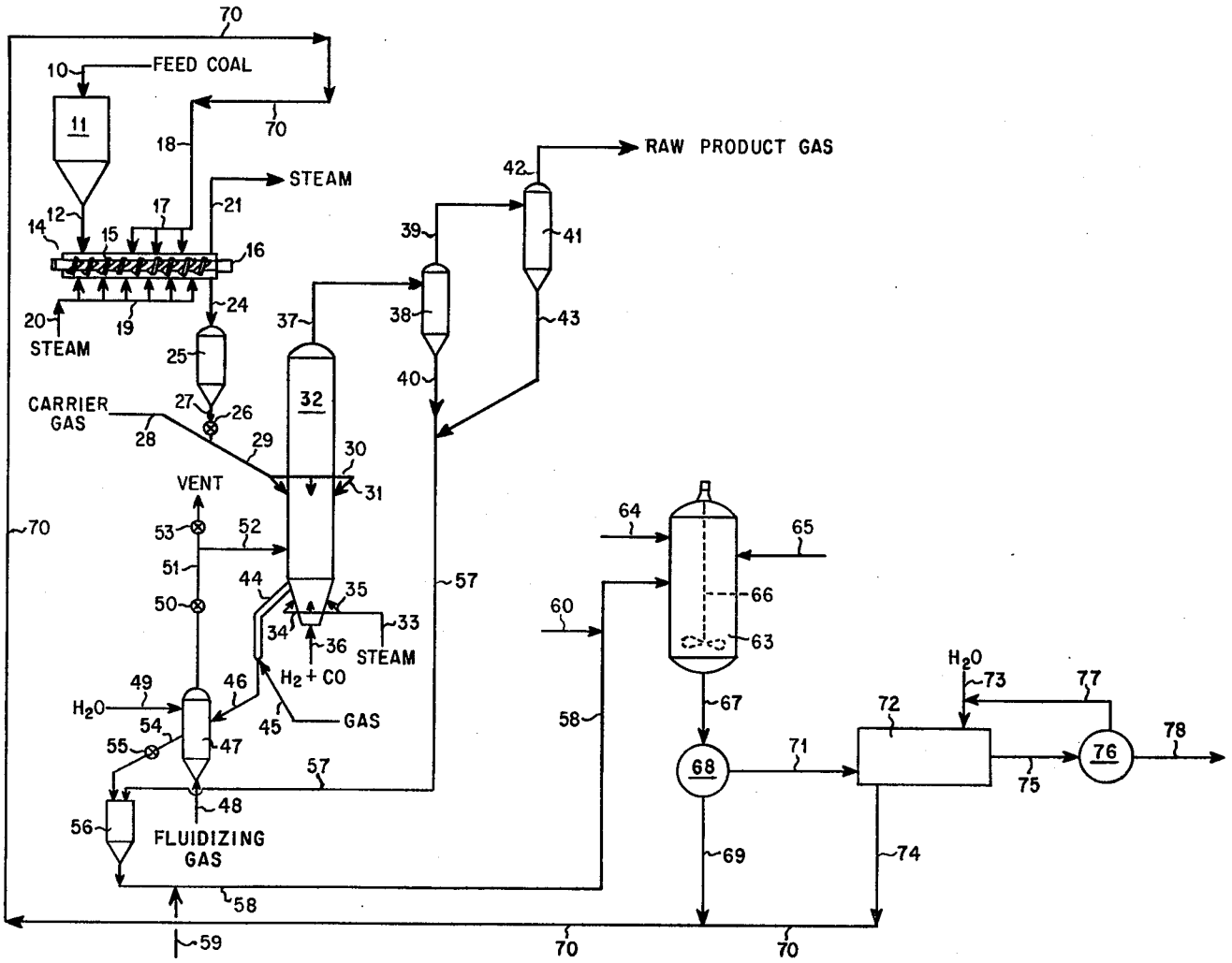
FEED COAL
STEAM
STEAM
CARRIER GAS
VENT
RAW PRODUCT GAS
STEAM
$H_2 + CO$
GAS
FLUIDIZING GAS
$H_2O$
$H_2O$

HYDROTHERMAL ALKALI METAL CATALYST RECOVERY PROCESS

The government of the United States of America has rights in this invention pursuant to Contract No. E(49-18)-2369 awarded by the U.S. Energy Research and Development Administration.

BACKGROUND OF THE INVENTION

1. Field of the Invention

This invention relates to the conversion of coal and similar carbonaceous solids in the presence of alkali metal-containing catalysts and is particularly concerned with the recovery of alkali metal constituents from spent solids produced during coal gasification and similar operations and their reuse as constituents of the alkali metal-containing catalysts.

2. Description of the Prior Art

Potassium carbonate, cesium carbonate and other alkali metal compounds have been recognized as useful catalysts for the gasification of coal and similar carbonaceous solids. The use of such compounds in coal liquefaction, coal carbonization, coal combustion and related processes has been proposed. To secure the higher reaction rates made possible by the presence of the alkali metal compounds it has been suggested that bituminous coal, subbituminous coal, lignite, petroleum coke, oil shale, organic wastes and similar carbonaceous materials be mixed or impregnated with potassium, cesium, sodium or lithium compounds, alone or in combination with other metallic constituents, before such materials are reacted with steam, hydrogen, oxygen or other agents at elevated temperatures to produce gaseous and/or liquid effluents. Studies have shown that a wide variety of different alkali metal compositions can be used for this purpose, including both organic and inorganic salts, oxides, hydroxides and the like. In general the above-described studies indicate that cesium compounds are the most effective gasification catalysts followed by potassium, sodium and lithium compounds in that order. Because of the relatively high cost of cesium compounds and the low effectiveness of lithium compounds, most of the experimental work performed in this area in the past has been directed toward the use of compounds of potassium and sodium. This work has shown that the potassium compounds are substantially more effective than the corresponding sodium compounds. Attention has therefore been focused on the use of potassium carbonate.

Coal gasification processes and similar operations carried out in the presence of alkali metal compounds at high temperatures generally result in the formation of chars and alkali metal residues. The chars normally include unconverted carbonaceous constituents of the coal or other feed material and various inorganic constituents generally referred to as ash. It is generally advisable to withdraw a portion of the char from the reaction zone during gasification and similar operations in order to eliminate the ash and prevent it from building up within the reaction zone or other vessels in the system. Elutriation methods and other techniques for separating char particles of relatively high ash content and returning particles of relatively low ash content to the reaction zone in order to improve the utilization of carbon in such processes has been suggested. In gasification and other processes referred to above that utilize alkali metal-containing catalysts, the cost of the alkali metal constituents is a significant factor in determining the overall cost of the process. In order to maintain catalyst cost at reasonable levels, it is essential that the alkali metal constituents be recovered and reused. There have been proposals for the recovery of alkali metal constituents by leaching as they are withdrawn from the reaction zone with char during operations of the type referred to above. Studies indicate that these constituents are generally present in part as carbonates and other water soluble compounds which can be recovered by water washing. Experience has shown that only a portion of the potassium carbonate or other alkali metal constituents is normally recovered and that substantial quantities of makeup alkali metal compounds are therefore required. This adds appreciably to the cost of such operations.

It has recently been found that increased amounts of alkali metal constituents can be effectively recovered in the form of alkali metal carbonates from the char particles by treating them with calcium hydroxide in the presence of water at elevated temperatures and pressures and thereafter contacting the resultant aqueous solution with carbon dioxide to precipitate any aluminum in solution and to form alkali metal carbonates. The calcium ions from the calcium hydroxide evidently react with alkali metal aluminosilicates and other insoluble alkali metal compounds in the char particles thereby liberating alkali metal constituents which dissolve into solution. The resultant solution is then carbonated and recycled to the reaction zone where the resulting alkali metal carbonates are reused as at least a portion of the alkali metal-containing catalyst. Although this process permits additional recovery of alkali metal constituents in the form of carbonates, a certain amount of expensive, catalytically active makeup alkali metal compounds such as carbonates is still required along with a carbon dioxide stripping step. Moreover, undesirable and poorly catalytic metal sulfates, which are extracted from the char during the treatment step, tend to buildup in the recycle solution.

SUMMARY OF THE INVENTION

The present invention provides an improved process for the recovery of alkali metal constituents from char particles produced during coal gasification and other conversion processes carried out in the presence of an alkali metal-containing catalyst which alleviates the problems referred to above. In accordance with the invention, it has now been found that substantial amounts of alkali metal constituents can be effectively recovered from particles containing alkali metal residues produced during coal gasification and related high temperature conversion processes primarily in the form of alkali metal formates by treating the particles with a calcium or magnesium-containing compound in the presence of water at temperatures ranging from about 250° F. to about 700° F. and in the presence of added carbon monoxide. Under these conditions the calcium or magnesium-containing compound and the carbon monoxide react with both water soluble and water insoluble compounds in the alkali metal residues to produce water insoluble precipitates and an aqueous solution containing primarily alkali metal formates. These alkali metal formates are then used in the conversion process as at least a portion of the alkali metal constituents which comprise the alkali metal-containing catalyst. Preferrably, such use is achieved by recycling the solution directly to the conversion process. If desired, however, the alkali metal formates may first be recovered from the solution and then used in the conversion process. Any makeup alkali metal compound required may be obtained by adding an inexpensive alkali metal sulfate to the treatment step where it will be converted into additional catalytically active alkali metal formate, which then serves as the makeup compound. Alkali metal sulfates originally present in the particles fed to the treatment step are also converted to alkali metal formates and therefore do not buildup in the process.

The invention is based in part upon studies of the reactions that catalysts containing alkali metal constituents undergo during coal gasification and similar operations. Coal and other carbonaceous solids used in such operations normally contain mineral constituents that are converted to ash during the gasification process. Although the composition of ash varies, the principal constituents, expressed as oxides, are generally silica, alumina and ferric oxide. The alumina is usually present in the ash in the form of aluminosilicates. Studies have indicated that at least a portion of the alkali metal compounds that are used as gasification catalyst constituents react with the aluminosilicates and other ash constituents to form alkali metal residues containing water soluble alkali metal compounds such as carbonates, sulfates and the like and water insoluble, catalytically inactive materials such as alkali metal aluminosilicates and alkali metal iron sulfides. Unless the alkali metals in these water insoluble compounds can be recovered, they are lost from the process and must be replaced by expensive makeup alkali metal compounds.

The process of the invention, unlike a similar process proposed in the past, does not require carbon dioxide stripping of the aqueous solution produced in the initial treatment step, prevents the buildup of poorly catalytic alkali metal sulfates, makes it possible to use inexpensive potassium sulfate or other alkali metal sulfate as a source of makeup alkali metal compounds, and thus makes possible substantial savings in gasification and other conversion operations carried out in the presence of alkali metal-containing catalysts and permits the generation of product gases and/or liquids at significantly lower cost than would otherwise be the case.

BRIEF DESCRIPTION OF THE DRAWING

The drawing is a schematic flow diagram of a catalytic coal gasification process in which alkali metal constituents of the catalyst are recovered and reused in the process.

DESCRIPTION OF THE PREFERRED EMBODIMENTS

The process depicted in the drawing is one for the production of methane by the gasification of a bituminous coal, subbituminous coal, lignite or similar carbonaceous solids with steam at high temperature in the presence of a carbon-alkali metal catalyst prepared by impregnating the feed solids with a solution of an alkali metal compound or a mixture of such compounds and thereafter heating the impregnated material to a temperature sufficient to produce an interaction between the alkali metal and the carbon present. It will be understood that the alkali metal recovery system disclosed is not restricted to this particular gasification process and that it can be employed in conjunction with any of a variety of other conversion processes in which alkali metal compounds or carbon-alkali metal catalysts are used to promote the reaction of steam, hydrogen, oxygen or the like with carbonaceous feed materials to produce a char, coke or similar solid product containing alkali metal residues from which alkali metal compounds are recovered for reuse as the catalyst or a constituent of the catalyst. It can be employed, for example, for the recovery of alkali metal compounds from various processes for the gasification of coal, petroleum coke, lignite, organic waste materials and similar solids feed streams which produce spent carbonaceous solids. Other conversion processes with which it may be used include operations for the carbonization of coal and similar feed solids, for the liquefaction of coal and related carbonaceous materials, for the retorting of oil shale, for the partial combustion of carbonaceous feed materials, and the like. Such processes have been disclosed in the literature and will be familiar to those skilled in the art.

In the process depicted in the drawing, a solid carbonaceous feed material such as bituminous coal, subbituminous coal, lignite or the like that has been crushed to a particle size of about 8 mesh or smaller on the U.S. Sieve Series Scale is passed into line 10 from a feed preparation plant or storage facility that is not shown in the drawing. The solids introduced into line 10 are fed into a hopper or similar vessel 11 from which they are passed through line 12 into feed preparation zone 14. This zone contains a screw conveyor or similar device 15 that is powered by a motor 16, a series of spray nozzles or similar devices 17 for the spraying of alkali metal-containing solution supplied through line 18 onto the solids as they are moved through the preparation zone by the conveyor, and a similar set of nozzles or the like 19 for the introduction of steam into the preparation zone. The steam, supplied through line 20, serves to heat the impregnated solids and drive off the moisture. Steam is withdrawn from zone 14 through line 21 and passed to a condenser, not shown, from which it may be recovered for use as makeup water or the like. The alkali metal-containing solution is recycled through line 70 from the alkali metal recovery section of the process, which is described in detail hereafter.

It is preferred that sufficient alkali metal-containing solution be introduced into feed preparation zone 14 to provide from about 1 to about 50 weight percent of the alkali metal compound or mixture of such compounds on the coal or other carbonaceous solids. From about 1 to about 15 weight percent is generally adequate. The dried impregnated solid particles prepared in zone 14 are withdrawn through line 24 and passed to a closed hopper or similar vessel 25. From here they are discharged through a starwheel feeder or equivalent device 26 in line 27 at an elevated pressure sufficient to permit their entrainment into a stream of high pressure steam, recycle product gas, inert gas or other carrier gas introduced into line 29 via line 28. The carrier gas and entrained solids are passed through line 29 into manifold 30 and fed from the manifold through feedlines 31 and nozzles, not shown in the drawing, into gasifier 32. In lieu of or in addition to hopper 25 and starwheel feeder 26, the feed system may employ parallel lock hoppers, pressurized hoppers, aerated standpipes operated in series, or other apparatus to raise the input feed solids stream to the required pressure level.

It is generally preferred to operate the gasifier 32 at a pressure between about 100 and about 2000 psig. The carrier gas and entrained solids will normally be introduced at a pressure somewhat in excess of the gasifier operating pressure. The carrier gas may be preheated to a temperature in excess of about 300° F. but below the initial softening point of the coal or other feed material employed. Feed particles may be suspended in the carrier gas in a concentration between about 0.2 and about 5.0 pounds of solid feed material per pound of carrier gas. The optimum ratio for a particular system will depend in part upon feed particle size and density, the molecular weight of the gas employed, the temperature of the solid feed material and input gas stream, the amount of alkali metal compound employed and other factors. In general, ratios between about 0.5 and about 4.0 pounds of solid feed material per pound of carrier gas are preferred.

Gasifier 32 comprises a refractory lined vessel containing a fluidized bed of carbonaceous solids extending upward within the vessel above an internal grid or similar distribution device not shown in the drawing. The bed is maintained in the fluidized state by means of steam introduced through line 33, manifold 34 and peripherally spaced injection lines and nozzles 35 and by means of recycle hydrogen and carbon monoxide introduced through bottom inlet line 36. The particular injection system shown in the drawing is not critical and hence other methods for injecting the steam and recycle hydrogen and carbon monoxide may be employed. In some instances, for example, it may be preferred to introduce both the steam and recycle gases through multiple nozzles to obtain more uniform distribution of the injected fluid and reduce the possibility of channeling and related problems. The space velocity of the rising gases within the fluidized bed will normally be between about 300 and 3000 volumes of steam and recycle hydrogen and carbon monoxide per hour per volume of fluidized solids.

The injected steam reacts with carbon in the feed material in the fluidized bed in gasifier 32 at a temperature within the range between about 800° F. and about 1600° F. and at a pressure between about 100 and about 2000 psig. Due to the equilibrium conditions existing in the bed as the result of the presence of the carbon-alkali metal catalyst and the recycle hydrogen and carbon monoxide injected near the lower end of the bed, the reaction products will normally consist essentially of methane and carbon dioxide. Competing reactions which in the absence of the catalyst and the recycle gases would ordinarily tend to produce additional hydrogen and carbon monoxide are suppressed. The ratio of methane to carbon dioxide in the raw product gas thus formed will preferrably range from about 1 to about 1.4 moles per mole, depending upon the amount of hydrogen and oxygen in the feed coal or other carbonaceous solids. The coal employed may be considered as an oxygenated hydrocarbon for purposes of describing the reaction. Wyodak coal, for example, may be considered as having the approximate formula $CH_{0.84}O_{0.20}$, based on the ultimate analysis of moisture and ash-free coal and neglecting nitrogen and sulfur. The reaction of this coal with steam to produce methane and carbon dioxide is as follows:

$$1.24\ H_2O(g) + 1.8\ CH_{0.84}O_{0.20} \rightarrow 0.8\ CO_2 + CH_4.$$

Under the same gasification conditions, coals of higher oxygen content will normally produce lower methane to carbon dioxide ratios and those of lower oxygen content will yield higher methane to carbon dioxide ratios.

The gas leaving the fluidized bed in gasifier 32 passes through the upper section of the gasifier, which serves as a disengagement zone where particles too heavy to be entrained by the gas leaving the vessel are returned to the bed. If desired, this disengagement zone may include one or more cyclone separators or the like for removing relatively large particles from the gas. The gas withdrawn from the upper part of the gasifier through line 37 will normally contain methane and carbon dioxide produced by reaction of the steam with carbon, hydrogen and carbon monoxide introduced into the gasifier as recycle gas, unreacted steam, hydrogen sulfide, ammonia and other contaminants formed from the sulfur and nitrogen contained in the feed material, and entrained fines. This gas is introduced into cyclone separator or similar device 38 for removal of the larger fines. The overhead gas then passes through line 39 into a second separator 41 where smaller particles are removed. The gas from which the solids have been separated is taken overhead from separator 41 through line 42 and the fines are discharged downward through dip legs 40 and 43. These fines may be returned to the gasifier or passed to the alkali metal recovery section of the process as discussed hereafter.

After entrained solids have been separated from the raw product gases described above, the gas stream may be passed through suitable heat exchange equipment for the recovery of heat and then processed for the removal of acid gases. Once this has been accomplished, the remaining gas, consisting primarily of methane, hydrogen and carbon monoxide, may be cryogenically separated into a product methane stream and a recycle stream of hydrogen and carbon monoxide, which is returned to the gasifier through line 36. Conventional gas processing equipment can be used. Since a detailed description of this downstream gas processing portion of the process is not necessary for an understanding of the invention, it has been omitted.

The fluidized bed in gasifier 32 is comprised of char particles formed as the solid carbonaceous feed material undergoes gasification. The composition of the char particles will depend upon the amount of mineral matter present in the carbonaceous material fed to the gasifier, the amount of the alkali metal compound or mixture of such compound impregnated into the feed material, and the degree of gasification that the char particles undergo while in the fluidized bed. The lighter char particles, which will have a relatively high content of carbonaceous material, will tend to remain in the upper portion of the fluidized bed. The heavier char particles, which will contain a relatively small amount of carbonaceous material and a relatively large amount of ash and alkali metal residues, will tend to migrate toward the bottom of the fluidized bed. A portion of the heavier char particles are normally withdrawn from the bottom portion of the fluidized bed in order to eliminate ash and thereby prevent it from building up within the gasifier and other vessels in the system.

The process of this invention is based in part upon the fact that alkali metal constituents of the gasification catalyst react with the mineral constituents of the coal and other carbonaceous solids during the gasification process. Studies have indicated that at least a portion of the alkali metal compounds, such as potassium carbonate, sodium carbonate and the like, that are used as gasification catalyst constituents react with the aluminosilicates and other ash constituents to form alkali metal residues containing water soluble alkali metal compounds such as carbonates, sulfates and the like and catalytically inactive materials such as alkali metal aluminosilicates, alkali metal iron sulfides and other water insoluble compounds.

It has been found that a significant amount of the potassium carbonate or other alkali metal compound employed to impregnate coal or similar feed material prior to gasification will react with the aluminosilicates and other ash constituents during gasification to form alkali metal aluminosilicates, alkali metal iron sulfides and other water insoluble catalyst residues which cannot normally be recovered from the ash by water washing. Preliminary studies tend to indicate that when potassium carbonate is utilized to impregnate the coal one of the major constituents of the water insoluble alkali metal residues produced is a synthetic kaliophilite, which has the chemical formula $KAlSiO_4$.

To improve the economics of the catalytic gasification process described above and other catalytic conversion processes where water insoluble alkali metal residues are formed, it is desirable to recover as much as possible of the alkali metal constituents from the insoluble residues and reuse them as catalyst constituents in the conversion process, thereby decreasing the amount of costly makeup alkali metal compounds needed. It has been found that a substantial amount of the alkali metal constituents in both the water soluble and water insoluble alkali metal residues withdrawn with the char and ash from the gasifier of the above-described process or the reaction zone of other conversion processes can be recovered in the form of alkali metal formates for reuse in the conversion process by treating the particles withdrawn from the reaction zone with a calcium or magnesium-containing compound in the presence of liquid water at a temperature between about 250° F. and about 700° F. and in the presence of added carbon monoxide. During the treating process the magnesium or calcium-containing compound reacts with compounds in the alkali metal residues and carbon monoxide to produce water soluble alkali metal formates and water insoluble precipitates containing among other components calcium or magnesium silicates, sulfates, aluminosilicates and aluminum hydroxide. The alkali metal formates thus formed are then used in the conversion process as at least a portion of the alkali metal constituents which comprise the alkali metal-containing catalyst. Preferrably, such use is achieved by recycling the solution directly to the conversion process. If desired, however, the alkali metal formates may first be recovered from the solution and then used in the conversion process.

Referring again to the drawing, char particles containing carbonaceous material, ash and alkali metal residues are continuously withdrawn through line 44 from the bottom of the fluidized bed in gasifier 32. The particles flow downward through line 44 countercurrent to a stream of steam or other elutriating gas introduced through line 45. Here, a preliminary separation of solids based on differences in size and density takes place. The lighter particles having a relatively large amount of carbonaceous material tend to be returned to the gasifier and the heavier particles having a relatively high content of ash and alkali metal residues continue downward through line 46 into fluidized bed withdrawal zone 47. Steam or other fluidizing gas is introduced into the bottom of the withdrawal zone through line 48 to maintain the bed in fluidized state. Water may be introduced through line 49 in order to cool the particles and facilitate their further processing. The withdrawal rate is controlled by regulating the pressure within zone 47 by means of a throttle valve 50 in overhead line 51. The gases from line 51 may be returned to the gasifier through line 52 or vented through valve 53. From vessel 47 the solid particles are passed through line 54 containing valve 55 into hopper 56.

The solid particles in hopper 56 are now ready for treatment to recover alkali metal constituents. These particles are combined with char fines recovered from the raw product gas through dip legs 40 and 43 and line 57 and are fed into line 58 where they are slurried with water injected through line 59. The resultant slurry is passed into autoclave or similar reaction vessel 63, which is equipped with stirrer 66. Here water soluble alkali metal residues in the char particles and the water insoluble alkali metal residues react with a calcium or magnesium-containing compound introduced into the reactor through line 65 and carbon monoxide introduced into the reactor through line 64 to form an aqueous solution containing water soluble alkali metal constituents primarily in the form of alkali metal formates. Stirrer 66 is constantly operated during the reaction to at least partially prevent agglomeration of the reactants.

An example of one reaction that is believed to take place in autoclave 63 is set forth below. For purposes of writing the equation, it is assumed that calcium hydroxide is used as a calcium-containing compound. The symbol "M" is used to represent any alkali metal cation. The actual alkali metal present will depend on the type of alkali metal compound utilized as a constituent of the alkali metal-containing gasification catalyst.

$$MAlSiO_4 + CO + 2Ca(OH)_2 \xrightarrow[\Delta]{H_2O} MCHO_2 + Ca_2SiO_4 \downarrow + Al(OH)_3 \downarrow$$

As can be seen from the above equation, an alkali metal aluminosilicate reacts with calcium hydroxide and carbon monoxide in the presence of hot water to yield a water soluble alkali metal formate, and water insoluble dicalciumsilicate and aluminum hydroxide. It will be understood that the above equation represents only one reaction that may take place in the autoclave. Reactions involving more complicated alkali metal aluminosilicates and other insoluble constituents of the alkali metal residues such as alkali metal iron sulfides may also take place. Furthermore, the form of the insoluble species produced from the reactions that take place may be different from those shown in the above equation and may consist of other calcium silicates, aluminates, aluminosilicates and other insoluble compounds, depending upon the types of insoluble constituents in the alkali metal residues. Normally, the resulting aqueous solution will consist substantially of alkali metal formates and will have negligible amounts of alumina or silica in solution. If magnesium hydroxide is used in place of calcium hydroxide as one of the reactants in the above equation then the precipitates will contain magnesium cations in place of calcium cations.

The actual role of the water in the reactions of the calcium or magnesium-containing compound with the insoluble alkali metal residues is not definitely known. It is theorized, however, that the primary purpose of the water is to provide more favorable reaction kinetics by serving as a medium in which calcium or magnesium ions are very mobile. If the amount of water in the slurry formed in line 58 is insufficient to provide optimum kinetics, additional water should be added to the slurry through line 60 before it is injected into autoclave 63.

The temperature in autoclave 63 will normally be maintained in the range between about 250° F. and about 700° F., perferably in the range between about 300° F. and about 450° F. and most preferably at a temperature of about 400° F. Since the water in autoclave 63 must always be present in the liquid state to provide the medium for the reactions that take place, the pressure in the autoclave should normally be equal to or greater than the vapor pressure of water at the operating temperature. The amount of carbon monoxide added to the autoclave will depend in part upon the amount of alkali metal residues present in the char withdrawn from the gasifier.

The calcium or magnesium compound used as one of the reactants in the reactions taking place in the autoclave may be any inorganic or organic calcium or magnesium-containing compound that at least partially ionizes or dissociates in water to yield calcium or magnesium ions. The calcium-containing compound may, for example, be calcium oxide, calcium hydroxide, calcium acetate, calcium oxylate, or the like. Similarly, the magnesium-containing compound may be magnesium oxide, magnesium hydroxide, magnesium acetate, magnesium oxylate, or the like. The actual magnesium or calcium-containing compound used will depend primarily upon its availability, cost and degree of solubility in the reaction medium present in the autoclave. The amount of the calcium or magnesium compound needed will depend in part on the amount of insoluble alkali metal residues in the particulate matter fed to autoclave 63. If desired, a mixture of two or more calcium or magnesium-containing compounds may be used in lieu of a single compound.

The slurry effluent from reactor 63 is withdrawn through line 67 and passed to centrifuge or other solids-liquids separation device 68 where the aqueous solution containing water soluble alkali metal constituents, primarily alkali metal formates, is separated from the particulate matter originally fed to autoclave 63 and the water insoluble precipitates formed by the reactions taking place in the autoclave. The aqueous solution is removed from the centrifuge through line 69 and is recycled to feed preparation zone 14 via lines 70, 18 and 17. Here the coal or similar carbonaceous feed material is impregnated with the alkali metal formates and other alkali metal constituents in the aqueous solution.

The solids removed from centrifuge 68 will contain entrained liquid containing alkali metal formates. These solids are passed through line 71 into water wash zone 72 where substantially all of the remaining water soluble alkali metal constituents are removed from the solids. The water wash zone will normally comprise a multistage countercurrent extraction system in which the solids are countercurrently contacted with water introduced through line 73. A dilute aqueous solution containing alkali metal formates is removed from the unit through line 74 and may be recycled through lines 70, 18 and 17 to feed preparation zone 14.

Particles from which substantially all of the alkali metal formates and other water soluble alkali metal constituents have been extracted are withdrawn from the water wash zone in slurry form through line 75 and passed to centrifuge or other solids-liquids separation device 76. Here the solids are removed from the water which will have a very low concentration of alkali metal formates and may be recycled back to water wash zone 72 via line 77. The solids are removed from the filter through line 78 and will contain, among other substances, small amounts of carbonaceous material, ash, calcium silicates, and aluminum hydroxide. These solids may be disposed of as landfill or further processed to recover valuable components or used in the manufacture of cement.

It is normally not possible to recover all of the alkali metal constituents in the alkali metal residues withdrawn with the char from gasifier 32. Some of these constituents will be lost with the solids eventually exiting the process from filter 76 through line 78. Thus, the amount of alkali metal constituents recycled from centrifuge 68 and water wash zone 72 to feed preparation zone 14 through lines 70, 18 and 17 will not be sufficient to entirely replace all of the alkali metal constituents originally present in the carbon-alkali metal catalyst and makeup alkali metal compounds or constituents will therefore be required. Makeup compounds can be added to the system by dissolving a catalytically active alkali metal compound such as potassium carbonate or potassium hydroxide in water and adding the required amount of solution directly to the feed preparation zone. A cheaper and more preferable alternative, however, consists of adding a less expensive but poorly catalytic alkali metal sulfate such as potassium sulfate directly to autoclave 63. Here, the alkali metal sulfate will be converted into the catalytically active alkali metal formate by the following reaction in which "M" represents any alkali metal cation:

$$M_2SO_4 + 2CO + Ca(OH)_2 \rightarrow 2MCHO_2 + CaSO_4 \downarrow$$

The additional alkali metal formate produced by the above reaction serves as the required makeup compound and is recycled to the feed preparation zone along with the alkali metal constituents recovered from the alkali metal residues in the char injected into autoclave 63.

The nature and objects of the invention are further illustrated by the results of laboratory tests which indicate that a significant amount of alkali metal compounds can be recovered from the alkali metal residues in a char produced during the catalytic gasification of a coal.

To test the effectiveness of the proposed alkali metal recovery method, a tubing bomb having a one-inch outside diameter was charged with about 10 grams of char. The tubing bomb was rotated by a variable speed motor inside a tube furnace, which was equipped with a temperature controller. The char was derived from the fluid bed catalytic gasification of an Illinois No. 6 coal that had been impregnated with potassium carbonate. Before the char was fed into the tubing bomb, it was analyzed for total potassium and water soluble potassium. The char was placed in the tubing bomb along with calcium hydroxide and distilled water. Sufficient calcium hydroxide was used so that the slurry in the bomb contained a molar ratio of calcium to insoluble potassium of between about 0.6 and about 3.9. About 30½-inch slugs fabricated from ¼-inch steel rod were added to the tubing bomb to insure good agitation and to prevent caking or agglomeration. Between about 29 and 41 millimoles of carbon monoxide were added to the tubing bomb. The reaction was carried out at a temperature of about 200° C. (392° F.) for about three hours. The pressure at the beginning of the reaction was about 450 psig and decreased to about 240 psig at the end of the reaction when all the carbon monoxide was consumed. The partial pressure of carbon monoxide at the beginning of the reaction was approximately 210 psi but decreased as the carbon monoxide was consumed during the reaction. At the end of the reaction the contents of the reactor were rapidly cooled and a solid residue separated by filtration. The solids from the bomb were washed twice with about 500 ml. of distilled water. The recovered liquid was analyzed for potassium and the percent potassium recovery was calculated based on the amount of total potassium in the starting char material. The results of these tests are set forth below in Table I.

TABLE I

POTASSIUM RECOVERY FROM ILLINOIS CHAR

| Total Potassium Charged (Milli-moles) | Calcium Hydroxide Charged (Milli-moles- | Carbon Monoxide Charged (Millimoles) | Percent Soluble Potassium In Charge | Percent Total Potassium Recovered |
|---|---|---|---|---|
| 85 | 27 | 41 | 51 | 63 |
| 85 | 54 | 41 | 51 | 85 |
| 85 | 108 | 41 | 51 | 74 |
| 85 | 162 | 29 | 51 | 85 |

It can be seen from Table I that the calcium hydroxide and carbon monoxide free a substantial amount of the insoluble potassium originally contained in the char. The total potassium recovery ranged from 63 to 85 percent, while only 51 percent of the potassium was originally water soluble.

It will be apparent from the foregoing that the process of the invention provides an alkali metal recovery system which makes it possible to recover alkali metal constituents from alkali metal residues produced during catalytic gasification and similar high temperature conversion processes and at the same time enables inexpensive alkali metal sulfates to be used as a source of makeup alkali metal compounds thereby lowering the overall cost of the conversion process.

We claim:

1. In a process for the conversion of a solid carbonaceous feed material in the presence of an alkali metal-containing catalyst into liquids and/or gases wherein particles containing alkali metal residues are produced, the improvement which comprises:

(a) treating said particles containing said alkali metal residues in a reaction zone with a calcium or magnesium-containing compound in the presence of liquid water at a temperature between about 250° F. and about 700° F. and in the presence of added carbon monoxide thereby converting water insoluble alkali metal constituents in said residues into water soluble alkali metal formates and producing an aqueous solution containing water soluble alkali metal constituents consisting primarily of alkali metal formates; and (b) using said alkali metal constituents from said aqueous solution in said conversion process as at least a portion of the alkali metal constituents comprising said alkali metal-containing catalyst.

2. A process as defined in claim 1 wherein said conversion process comprises gasification.

3. A process as defined in claim 1 wherein said conversion process comprises liquefaction.

4. A process as defined in claim 1 wherein at least a portion of said alkali metal-containing catalyst comprises potassium carbonate.

5. A process as defined in claim 1 wherein said particles containing said alkali metal residues are treated with a calcium-containing compound.

6. A process as defined in claim 5 wherein said calcium-containing compound comprises calcium hydroxide.

7. A process as defined in claim 1 wherein said carbonaceous feed material comprises coal.

8. A process as defined in claim 1 wherein said aqueous solution is recycled to said conversion process where said alkali metal formates are used as at least a portion of said alkali metal constituents comprising said alkali metal-containing catalyst.

9. A process as defined in claim 1 wherein an alkali metal sulfate is added to said reaction zone to produce additional water soluble alkali metal formate in said aqueous solution.

10. In a process for the gasification of coal in the presence of a carbon-alkali metal catalyst wherein particles containing akali metal residues are produced, the improvement which comprises:

(a) treating said particles containing said alkali metal residues in a reaction zone with a calcium-containing compound in the presence of liquid water at a temperature between about 250° F. and about 700° F. and in the presence of added carbon monoxide, thereby converting water insoluble alkali metal constituents in said residues into water soluble alkali metal formates and producing an aqueous solution containing water soluble alkali metal constituents consisting primarily of alkali metal formates; and (b) recycling said aqueous solution containing said water soluble alkali metal constituents to said gasification process where said alkali metal constituents are used as at least a portion of the alkali metal constituents comprising said carbon-alkali metal catalyst.

11. A process as defined in claim 10 wherein said particles are treated in the presence of said water and said added carbon monoxide at a temperature between about 300° F. and about 450° F.

12. A process as defined in claim 10 wherein an alkali metal sulfate is added to said reaction zone to produce additional water soluble alkali metal formates in said aqueous solution.

13. A process as defined in claim 12 wherein said carbon-alkali metal catalyst comprises a carbon-potassium reaction product and said alkali metal sulfate comprises potassium sulfate.

14. A process as defined in claim 10 wherein said calcium-containing compound comprises calcium hydroxide.

15. A process as defined in claim 10 wherein said calcium-containing compound comprises calcium oxide.

* * * * *